United States Patent [19]

Hill et al.

[11] 4,430,026

[45] Feb. 7, 1984

[54] ROOF SUPPORT SUITABLE FOR USE IN MINES

[75] Inventors: Nigel Hill, Pershore; Dennis F. Rutherford, Cheltenham, both of England

[73] Assignee: Dowty Mining Equipment Limited, Great Britain

[21] Appl. No.: 322,283

[22] Filed: Nov. 17, 1981

[30] Foreign Application Priority Data

Nov. 27, 1980 [GB] United Kingdom ..... 8037974

[51] Int. Cl.[3] ..... E21D 23/00

[52] U.S. Cl. ..... 405/291; 299/33

[58] Field of Search ..... 405/295, 294, 293, 291, 405/288; 299/33

[56] References Cited

U.S. PATENT DOCUMENTS 3,779,023 12/1973 Koppers ..... 405/295
3,928,981 12/1975 Parker et al. ..... 405/293
4,020,640 5/1977 Sigott et al. ..... 405/295
4,114,387 9/1978 Rutherford ..... 405/293
4,124,984 11/1978 Saunders ..... 405/293

FOREIGN PATENT DOCUMENTS 2104935 6/1979 Fed. Rep. of Germany ..... 405/293

*Primary Examiner*—Ernest R. Purser
*Assistant Examiner*—Beverly E. Hjorth
*Attorney, Agent, or Firm*—Hayes, Davis & Soloway

[57] ABSTRACT

A roof support suitable for use in mines includes roof-engageable means provided with a roof-engageable pad which is so mounted with respect to the remainder of the roof-engageable means as to be movable with respect thereto for exerting a thrust on the mine roof. A linkage is pivotally connected between the pad and the remainder of the roof-engageable means. Actuator means is so pivotally connected to and supported by the linkage that when operated it effects movement of the pad with respect to the remainder of the roof-engageable means, being itself constrained, simultaneously upon such movement, to move bodily with the pad.

6 Claims, 4 Drawing Figures

ROOF SUPPORT SUITABLE FOR USE IN MINES

Figure 1:
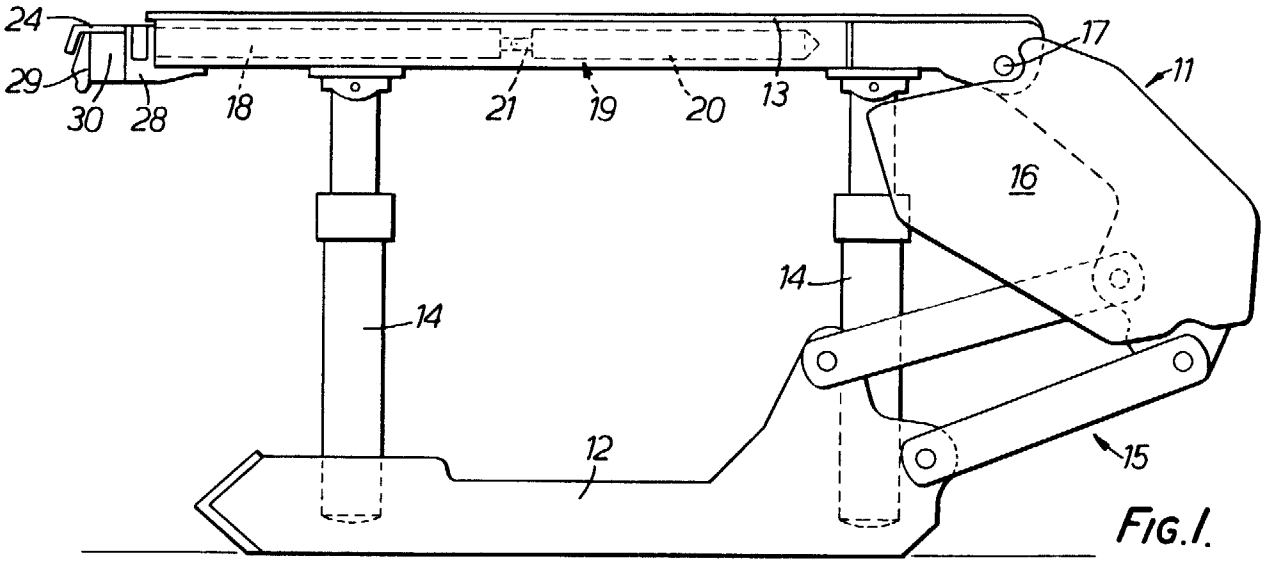

This invention relates to roof supports suitable for use in mines for supporting the mine roof during mineral-mining operations.

Certain of such roof supports include a floor-engaging structure, extendable and contractible prop means carried by said floor-engaging structure, and roof-engageable means supported by the prop means, said roof-engageable means including a roof-engageable pad which is movable with respect to the remainder of the roof-engageable means by actuator means for exerting a thrust on the mine roof.

The roof-engageable means may also include a canopy or like element and a cantilever member which is extendable and retractable with respect to said canopy. In this case said roof-engageable pad is carried by, and movable with respect to, that end portion of the cantilever member remote from said canopy, its thrust on the roof being constant, or substantially so, irrespective of the actual extension of the cantilever member with respect to the canopy.

Hitherto such roof-engageable pads have been moved in this manner through the intermediary of at least one bell-crank member which is directly pivotally connected to the pad and to the remainder of the roof-engageable means, the actuator means operating on this member and being mounted on or adjacent said remainder of the roof-engageable means. However with such arrangements the extent of movement of the pad with respect to the remainder of the roof-engageable means has been somewhat limited and in many situations it has been found inadequate for desired support of the roof immediately above the pad.

The invention as claimed is intended to provide a remedy. It solves the problem of how to design an improved roof support in which movement of a said roof-engageable pad with respect to the remainder of the roof-engageable means is not so limited.

According to the invention a roof support suitable for use in mines includes roof-engageable means which is provided with a roof-engageable pad so mounted with respect to the remainder of the roof-engageable means as to be movable with respect thereto for exerting a thrust on the mine roof, a linkage, pivotally connected between said pad and said remainder of thereof-engageable means, and actuator means which is pivotally connected to and supported by said linkage so that when said actuator means is operated it effects movement of the pad with respect to said remainder of the roof-engageable means, and is itself constrained, simultaneously upon such movement, to move bodily with said pad. The linkage may include a bell-crank member and a link member, one arm of the bell-crank member being pivotally connected to said pad and the other arm of the bell-crank member being pivotally connected to one end portion of the link member, while the other end portion of the link member is pivotally connected to said remainder of the roof-engageable means and the output member of said actuator means is pivotally connected to the bell-crank member at the junction of said arms.

The roof-engageable means may comprise a canopy and a cantilever member which is extendable and retractable with respect to said canopy, said roof-engageable pad being then carried by, and being movable with respect to, that end portion of the cantilever member remote from said canopy.

The advantages offered by the invention are mainly that the pad is afforded greater movement with respect to the remainder of said roof-engageable means and the actuator means is so carried by the structure as to have a desired limited freedom of bodily movement with respect to the pad.

Figure 2:
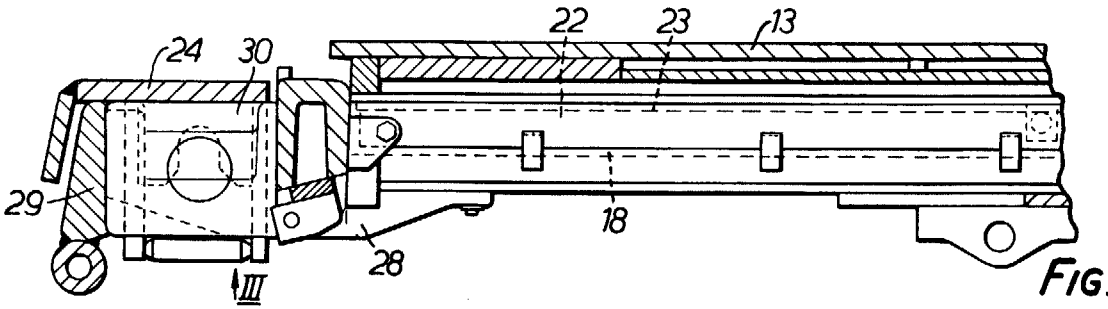
Figure 3:
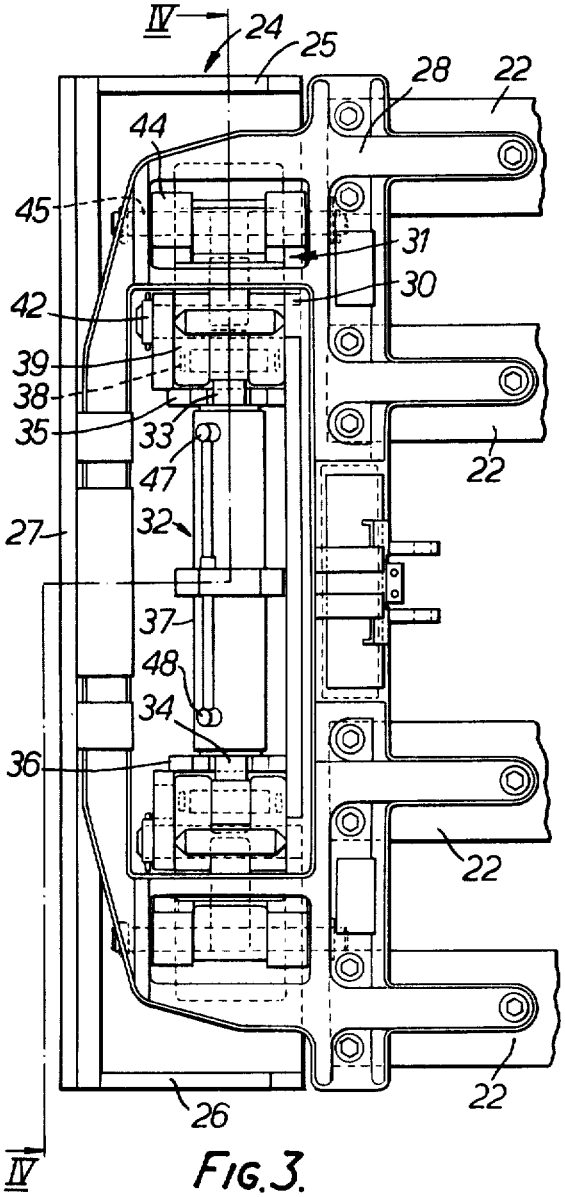
Figure 4:
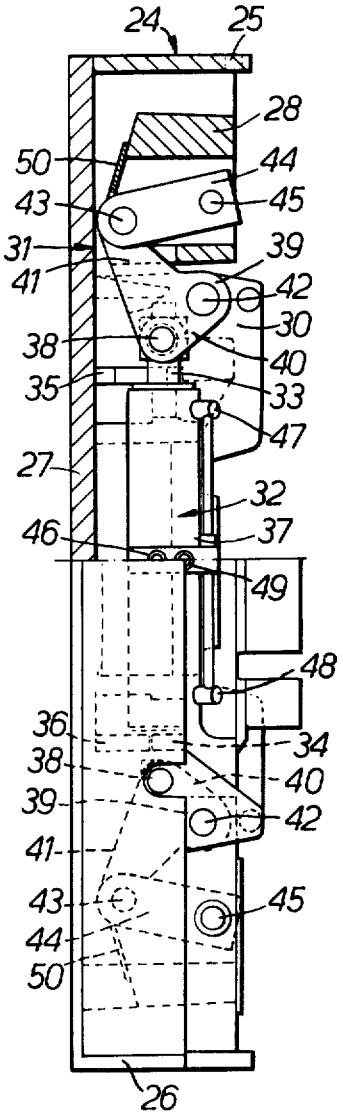

One way of carrying out the invention is described in detail below with reference to drawings which illustrate one specific embodiment, of which FIG. 1 is a side elevation of a roof support suitable for use in mines in accordance with the invention, FIG. 2 is a cross-sectional enlargement of part of the construction shown in FIG. 1, FIG. 3 is a view taken in the direction of the arrow III of part of FIG. 2, and, FIG. 4 is a cross-section taken along the line IV—IV on FIG. 3.

In the drawings a roof support 11 for use in a mine for supporting the mine roof during mineral-mining operations comprises a floor-engaging structure in the form of a floor beam 12, a main roof-engageable member which includes a canopy 13 and prop means in the form of a plurality of extendable and contractible hydraulically-operable props 14 which act between the floor beam and the canopy for adjustably urging the canopy into engagement with the mine roof.

At the rearward end portion of the floor beam 12, that is to the right in FIG. 1, a pivotal guide linkage 15 is provided which is connected to a goaf shield 16. This shield is pivotally connected at 17 to the rearward end portion of the canopy 13.

The main roof-engageable member also includes a cantilever member 18 which is extendable and retractable with respect to the canopy 13 by an hydraulic jack diagrammatically shown at 19 in FIG. 1. The cylinder 20 of this jack is disposed within and fast with the canopy, and its piston rod 21 is connected in convenient manner to the cantilever member.

The cantilever member includes a plurality of finger-like elements 22 which are slidable within complementary compartments 23 formed within the forward part of the canopy.

At this forward end portion the cantilever member is provided with a roof-engageable pad 24 which is so shaped and mounted with respect to the cantilever member as to be slidable substantially vertically towards and away from that portion of the mine roof immediately above it.

As shown in FIGS. 3 and 4 the pad 24 has a large width dimension, while its dimension in the fore-and-aft direction of the roof support is relatively small. In this way the profile of the pad is elongate transversely of the roof support. Side apron portions 25, 26 and a forward apron portion 27 are welded to the pad. Pad-supporting structure 28 is suitably bolted to the forward end portion of the elements 22 of the cantilever member 18 and this structure includes a slide 29. The pad 24 is provided with a base portion 30, which fits into this slide, and with operating mechanism which is generally indicated at 31 and interposed between the pad-supporting structure 28 and the base portion 30. This mechanism serves to effect raising and lowering of the pad with respect to the structure 28 and cantilever member 18.

The operating mechanism 31 includes actuator means in the form of a double hydraulically-operable telescopic jack unit 32 disposed with its axle lying transversely of the roof support, its two piston rods 33, 34 passing through guides which are formed by slotted brackets 35, 36 extending downwardly from the underside of the pad 24 and these brackets being disposed immediately adjacent either end of the double cylinder 37 of the jack unit thereby locating the unit adjacent the underside of the pad as shown in FIG. 4. The construction is such that the jack unit is movable bodily not only with the pad during its raising and lowering movement but, by virtue of the slots in the brackets 35, 36, is capable of movement upwardly and downwardly to a limited degree with respect to the pad.

Each of the piston rods 33, 34 is pivotally connected at 38 to a respective bell-crank member 39 at the effective junction of its two pairs of arms 40, 41. The shorter pair of arms 40 of each member 39 is pivotally connected at 42 to the pad base portion 30, while the longer pair of arms 41 is pivotally connected at 43 to one end portion of a respective double-link member 44 which itself is pivotally mounted at 45 at its other end portion on the pad-supporting structure 28.

When, with the cantilever member 18 retracted as shown, or, with it partly extended, or again, with it fully extended, the pad 24 is required to be raised from the position shown in the drawings to a roof-engaging or engageable position, liquid under pressure is introduced into both cylinders of the jack unit 32, which is of double-acting type, through the common connection 46, whereupon the piston rods 33, 34 commence to move outwardly of the cylinders, exhaust liquid from the cylinders passing out therefrom through the connections 47, 48 and to return by way of connection 49.

Both bell-crank members 39 in consequence commence to move angularly about their pivotal connections 42 to the pad base portion 30. Considering the member 39 seen in the upper part of FIG. 4, this moves in the clockwise direction and the linkage is so designed and mounted that the member 39 simultaneously also moves in the clockwise direction about the pivotal connection 43. The member 39 is therefore following two paths of movement resulting in the pivotal connection 42 being displaced upwardly towards the mine roof (that is to the left in FIG. 4), the pad base portion 30 and thus the pad 24 moving likewise. The pivotal connection 38 also moves in this way and the jack unit therefore bodily follows the upward movement of the pad, being constrained to do so by the linkage, the brackets 35 and 36 and the resultant interaction between that part of the operating mechanism 31 associated with the piston rod 33 and that part thereof associated with the piston rod 34.

As such movement occurs the double-link member 44 rocks about the pivotal mounting 45, sliding cover means 50 being provided to resist the ingress of mineral debris into parts of the mechanism 31.

When it is required to lower the pad the connection 46 is placed in communication with return and the connection 49, and thus the connections 47, 48, are charged with liquid under pressure so that the jack unit 32 is now contracted and the piston rods 33, 34 operate the bell-crank members 39 and link members 44 in the converse sense.

By so providing the double-link members 44 and arranging for the jack unit to move bodily with the pad 24, a relatively high degree of lift of the pad for roof support is provided.

The arrangement is such that if the mine roof which the pad is required to engage is so undulating in contour that the pad requires to adopt a tilted attitude in the sense transversely of the roof support as it engages the roof, the freedom of bodily movement, which is afforded the jack unit by its mounting, enables such tilting of the pad to be accommodated.

The invention is in no way limited to the provision of two bell-crank members and double-link members operated by a double jack unit as in the embodiment above-described with reference to the drawings, as in other embodiments of the invention different arrangements of jack unit and operating linkage are provided which likewise enable the jack unit to be constrained bodily to move with the roof-engageable pad during its raising and lowering movement.

Although in the embodiment above-described with reference to the drawings the roof-engageable pad is carried at the forward end portion of a cantilever member which is extendable and retractable with respect to a roof-engageable canopy, in alternative embodiments of the invention no cantilever member is provided and the roof-engageable pad together with its operating mechanism may be mounted directly on the forward end portion of the canopy.

The invention is not limited in its application to mine roof supports, as in other embodiments it is with advantage applied to other forms of roof support, or again to supports for use in other fields.

We claim:

1. A roof support, suitable for use in mines, comprising a main roof-engageable member, a roof-engageable pad which is mounted upon said main roof-engageable member for upward movement with respect thereto in order to exert a thrust on the mine roof, guide means extending downwardly from the underside of said pad, a linkage pivotally-connected between said pad and said main roof-engageable member, and actuator means, located by said guide means adjacent the underside of said pad, which actuator means has an output member pivotally-connected to said linkage whereby when said actuator means is operated said output member moves said linkage and thereby said pad with respect to said main roof-engageable member to provide said upward movement, said actuator means itself being moved bodily by said linkage, with said pad, to be maintained so adjacent the underside of said pad, wherein said linkage includes a bell-crank member and a link member which are pivotally-connected together, said bell-crank member having rigidly interconnected first and second arms and said link member having a first end portion and a second end portion, the first arm of the bell-crank member being pivotally-connected to said pad and the second arm of the bell-crank member being pivotally-connected to said first end portion of said link member, while the second end portion of said link member is pivotally-connected to said main roof-engageable member.

2. A roof support as claimed in claim 1, wherein said bell-crank member has a junction portion connecting its two said arms, and said output member of said actuator means is pivotally-connected to said junction portion.

3. A roof support as claimed in claim 2, wherein two of said bell-crank members and two of said link members are provided, said actuator means comprising a double jack unit having two of said output members, each of said output members being pivotally-connected to a respective said bell-crank member at said junction portion of that member.

4. A roof support as claimed in claim 3, wherein said double jack unit is an elongate unit extending transversely of said roof support.

5. A roof support, suitable for use in mines, comprising a main roof-engageable member, a roof-engageable pad which is mounted upon said main roof-engageable member for upward movement with respect thereto in order to exert a thrust on the mine roof, guide means extending downwardly from the underside of said pad, a linkage pivotally-connected between said pad and said main roof-engageable member, and actuator means, located by said guide means adjacent the underside of said pad, which actuator means has an output member pivotally-connected to said linkage whereby when said actuator means is operated said output member moves said linkage and thereby said pad with respect to said main roof-engageable member to provide said upward movement, said actuator means itself being moved bodily by said linkage, with said pad, to be maintained so adjacent the underside of said pad, wherein said linkage includes a bell-crank member and a link member which are pivotally-connected together, and wherein said bell-crank member has rigidly interconnected first and second arms and said link member has a first end portion and a second end portion, the first arm of the bell-crank member being pivotally-connected to said pad and the second arm of the bell-crank member being pivotally-connected to said first end portion of said link member, while the second end portion of said link member is pivotally-connected to said main roof-engageable member.

6. A roof support as claimed in claim 5, wherein said bell-crank member has a junction portion connecting its two said arms, and said output member of said actuator means is pivotally-connected to said junction portion.

* * * * *